United States Patent [19]

Vlad

[11] 3,971,678

[45] July 27, 1976

[54] METHOD OF MAKING COLD-ROLLED SHEET FOR ELECTRICAL PURPOSES

[75] Inventor: Constantin Vlad, Wolfenbuttel, Germany

[73] Assignee: Stahlwerke Peine-Salzgitter Aktiengesellschaft, Peine, Germany

[22] Filed: June 20, 1974

[21] Appl. No.: 481,320

Related U.S. Application Data

[63] Continuation of Ser. No. 365,446, May 31, 1973, abandoned.

[30] Foreign Application Priority Data

May 31, 1972 Germany ..... 2226379

[52] U.S. Cl. ..... 148/111; 148/31.55; 148/112

[51] Int. Cl.[2] ..... H01F 1/04

[58] Field of Search ..... 148/111, 112, 31.55, 148/120, 121, 122; 75/123 L

[56] References Cited

UNITED STATES PATENTS

| | | | |
|---|---|---|---|
| 2,209,687 | 7/1940 | Crafts | 148/111 |
| 2,307,391 | 1/1943 | Cole et al. | 148/120 |
| 3,058,857 | 10/1962 | Pavlovic et al. | 148/31.55 |
| 3,124,491 | 3/1964 | Foster | 148/31.55 |
| 3,159,511 | 12/1964 | Taguchi et al. | 148/111 |
| 3,212,942 | 10/1965 | Takahashi | 148/112 |
| 3,347,718 | 10/1967 | Carpenter et al. | 148/111 |
| 3,573,112 | 3/1971 | Aspden | 148/31.55 |
| 3,632,456 | 1/1972 | Sakakura et al. | 148/111 |
| 3,764,406 | 10/1973 | Littmann | 148/111 |

FOREIGN PATENTS OR APPLICATIONS

| | | | |
|---|---|---|---|
| 1,094,975 | 12/1967 | United Kingdom | 148/122 |

*Primary Examiner*—Walter R. Satterfield
*Attorney, Agent, or Firm*—Toren, McGeady and Stanger

[57] ABSTRACT

Alloy steel sheeting for electrical purposes such as the cores of transformers, is made with isotropic magnetic properties by a method in which steel containing, by weight, up to 0.1% carbon, from 0.15 to 0.35% manganese, from 0.3 to 2.4% aluminium up to 0.25% copper, up to 0.5% sulphur, up to 0.2% phosphorus, up to 2.0% silicon and the balance iron except for impurities is hot rolled at a temperature of from 820° to 1080°C to cause at least 5% of it to have a crystal orientation {100}<hkl>. After this the sheet is cold-rolled with a reduction in cross-section of from 50% to 85% and then it is recrystallization-annealed at a temperature of from 820° to 1200°C. Preferably the cold-rolling is carried out in two stages and the sheet is annealed for from 10 to 30 minutes at a temperature of from 550° to 950°C between the two stages.

6 Claims, 3 Drawing Figures

METHOD OF MAKING COLD-ROLLED SHEET FOR ELECTRICAL PURPOSES

Figure 1:
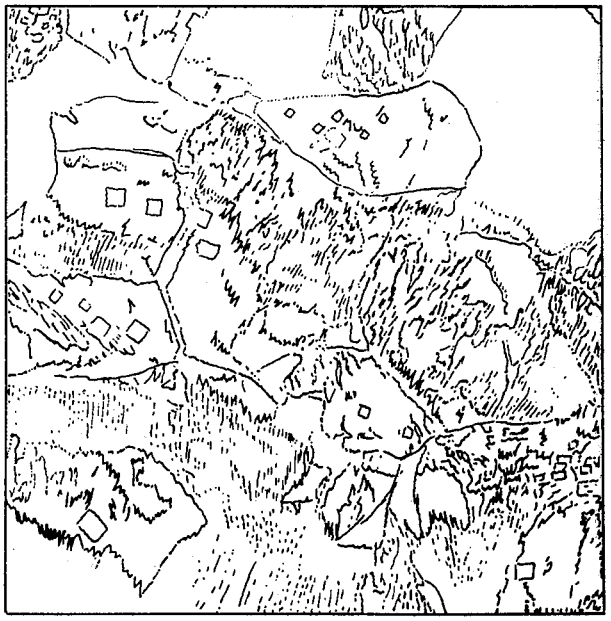

This is a continuation of application Ser. No. 365,446 filed May 31, 1973 and now abandoned.

This invention relates to the manufacture of cold-rolled sheet for electrical purposes which possesses a {100} <hkl> - orientation. The invention is concerned with a method of making such sheet in which steel containing carbon, manganese, aluminium, copper, sulphur, phosphorus and the balance iron except for impurities is first hot rolled, then cold rolled and then annealed.

Grain-oriented sheet with a so-called Goss texture {110} <001> possesses especially good magnetic properties, but it is anisotropic, that is to say the magnetic properties vary in different directions and are best in the direction of rolling. Thus, for example, the $V_{15}$ - watt loss of an 0.35 mm thick cold-rolled sheet, of conventional composition and possessing a Goss texture, is only 1.44 W/kg in the direction of rolling, but 3.08 W/kg in the transverse direction.

Sheet having anisotropic magnetic properties therefore suffers from the disadvantage that it can only be used for those purposes in which the lines of magnetic force lie in the direction of rolling. It cannot for example be used in the manufacture of electric motors.

It is the object of this invention to provide a method by which sheet for electrical purposes and having a {100} <hkl> - orientation and also possessing isotropic magnetic properties can be manufactured.

According to this invention, such sheet is made by a method in which steel containing, by weight, up to 0.1% carbon, from 0.15% to 0.35% manganese, from 0.3% to 2.4% aluminium, up to 0.25% copper, up to 0.05% sulphur, up to 0.02% phosphorus, up to 2.0% silicon and the balance iron except for impurities is hot rolled at a temperature of from 820° to 1080°C to bring it to at least 5% into a {100} <hkl> - orientation, the sheet is then cold-rolled with a reduction in cross-section of from 50% to 85% and after this is recrystallisation-annealed at a temperature of from 820° to 1200°C.

It will be noted that the aluminium content of the steel is between 0.3 and 2.4%. This is contrary to the conventional assumption that aluminium content for grain-oriented, silicon-containing sheet for electrical purposes should not exceed 0.02%.

It has been found that the composition of the steel, especially its aluminium content, and the rigorous maintenance of the rolling temperature and the reduction in cross-section during cold-rolling ensures that the steel acquires a structure with a {100} <hkl> - orientation and is magnetically isotropic.

The silicon content of the steel is determined in individual cases from the phase boundary between the $\alpha$-iron and the $\gamma$-iron.

In order to achieve a structure possessing the highest practicable uniformity of grain size, the steel may be normalised after the hot-rolling preferably for up to 15 minutes at a temperature of from 900° to 1000°C. The normalisation-annealing may take place with decarburisation, for example by annealing hot sheet still possessing its scale. Alternatively, a decarburising fixed bond annealing preferably in a DX-atmosphere having a dew point of −25°C may be used.

After pickling, the hot-rolled sheet is cold-rolled in order to give the desired orientation to the grain structure. A two-stage cold rolling may be used with an intermediate annealing step at from 550° to 950°C for from 10 to 30 minutes.

The annealing may be carried out in a reducing, decarburising atmosphere, in order to avoid the necessity for subsequent pickling. After cold-rolling, the sheet may be decarburisation-annealed.

The cold-rolled sheet is finally annealed just below the $A_3$-point. It is this that makes the annealing temperature 820° to 1200°C, depending upon the carbon content. This recrystallisation annealing may be carried out in a reducing atmosphere or in vacuum, in order to promote grain growth and the formation of the desired recrystallisation texture. The invention will now be explained in more detail with reference to a number of examples.

EXAMPLE 1

In an experiment, a steel containing, by weight, 0.016% carbon, 0.07% manganese, 0.61% aluminium, the balance iron except for impurities including 0.007% nitrogen was cast into ingot slabs and then rolled at 915°C into hot strip having a thickness of 3 mm. The hot strip was then pickled and cold-rolled with a thickness reduction of 84% down to a thickness of 0.48 mm, and then finally recrystallisation-annealed for 30 minutes at 850°C in a hydrogen atmosphere. The watt-losses of samples of the annealed cold strip were: 1.40 W/kg for $V_{10}$, and 2.08 W/kg for $V_{15}$.

EXAMPLE 2

The experiment of Example 1 was repeated on a steel containing 0.58% aluminium and 0.9% silicon. The hot strip was however decarburisation-annealed for 15 minutes at 1000°C, then cold-rolled with a thickness reduction of 83% to a strip thickness of 0.52 mm, and then recrystallisation-annealed for 30 minutes at 850°C in a hydrogen atmosphere. Specimens from the cold-rolled strip possessed a $V_{10}$-watt loss of 1.44 W/kg and a $V_{15}$-watt loss of 2.15 W/kg.

EXAMPLE 3

The experiment of Example 1 was repeated using a steel having an aluminium content of 1.37% and a silicon content of 2% and which, after hot-rolling, was cold-rolled with a thickness reduction of 81% to sheets having a thickness of 0.56 mm. With specimens from this sheet, a $V_{10}$-watt loss of 1.20 W/kg and a $V_{15}$-watt loss of 2.00 W/kg were obtained.

EXAMPLE 4

In a series of experiments, ten steels of the general composition mentioned in Example 1, but with differing aluminium contents, were hot-rolled and then, some with some without normalisation-annealing before the cold rolling, were each cold-rolled in two stages with a 30 minute intermediate annealing at 850°C between the stages. They were then recrystallised for one hour at 850°C and finally tested to find out their watt loss. The aluminium contents, final thicknesses, degrees of deformation and watt losses for each case can be seen from the following table.

| Steel | Al (%) | Final Thickness (mm) | Normalisation (°C/min) before cold-rolling | Reduction in thickness (%) | Watt losses (W/kg) $V_{10}$ | $V_{15}$ |
|---|---|---|---|---|---|---|
| 1 | 0.58 | 0.59 | none | 50 + 60.5 | 1.47 | 2.02 |
| 2 | 0.58 | 0.42 | none | 50 + 72 | 1.14 | 1.66 |
| 3 | 0.58 | 0.42 | none | 60 + 65 | 1.15 | 1.68 |
| 4 | 0.59 | 0.59 | 1000°C/15 | 50 + 60.5 | 1.33 | 1.80 |
| 5 | 0.59 | 0.45 | " | 50 + 70 | 1.20 | 1.72 |
| 6 | 0.59 | 0.44 | 1000°C/15 | 60 + 63.5 | 1.14 | 1.67 |
| 7 | 1.37 | 0.57 | none | 60 + 52.5 | 1.00 | 1.70 |
| 8 | 1.37 | 0.48 | none | 50 + 68 | 1.10 | 1.80 |
| 9 | 1.37 | 0.40 | none | 50 + 73.5 | 0.90 | 1.60 |
| 10 | 1.39 | 0.30 | none | 70 + 66.5 | 0.80 | 1.50 |

All the samples possess a grain structure having a {100} <hkl > 20 orientation, of which FIG. 1 illustrates an example with a magnification of 20. The watt losses shown in the table are evidence of the presence of the above-mentioned orientation. Metallographic investigation showed that the length of grain was at least five times the thickness of sheet.

EXAMPLE 5

In a further experiment, the method described in Example 4 was repeated but with a steel having an aluminium content of 2.3%. The sheet for electrical purposes made from this steel exhibited a $V_{10}$-watt loss of 1.0 W/kg and a $V_{15}$-watt loss of 1.6 W/kg for a specimen thickness of 0.43 mm.

Figure 2:
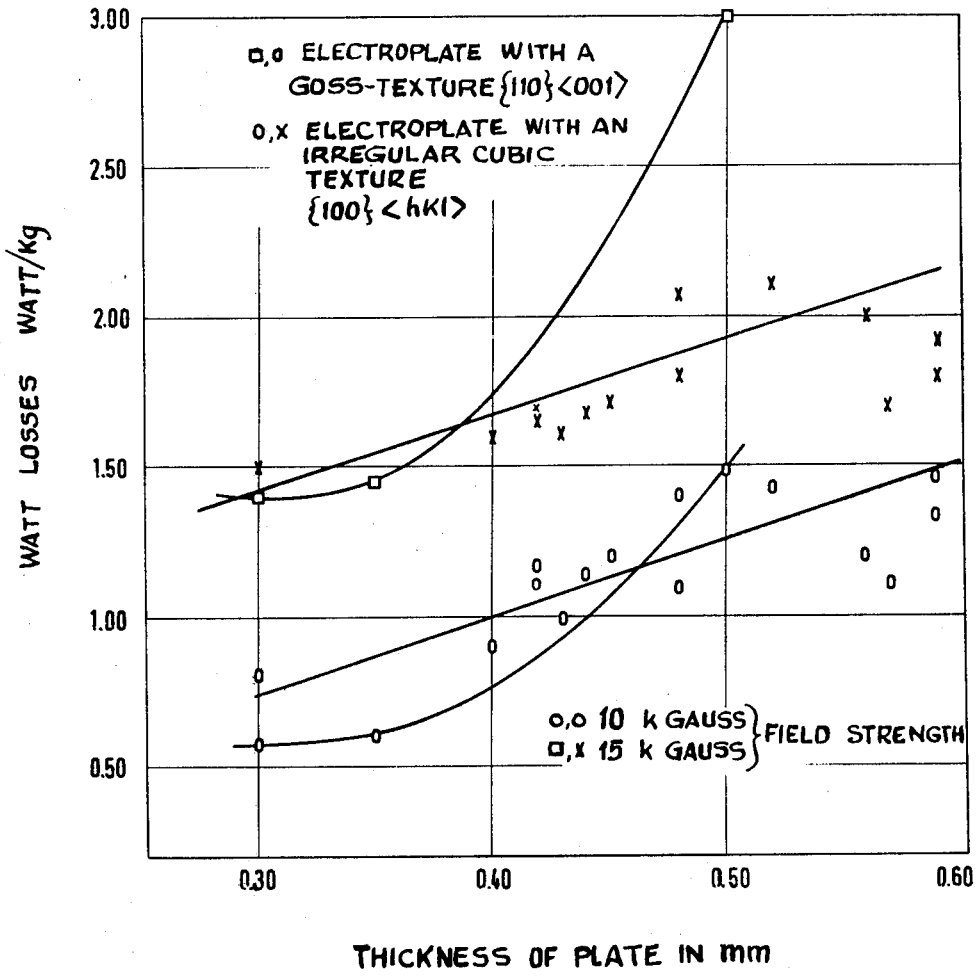

The diagram in FIG. 2 shows that with the method in accordance with the invention, especially in the range of fairly large thicknesses of sheet, low watt losses were found in all directions, and the steel is therefore magnetically isotropic. The superiority for electrical purposes of sheet made by the method of the invention, compared with the known grain-oriented sheet of the same thickness possessing a Goss texture is evident.

A further advantage of the method in accordance with the invention is that the aluminium content makes it possible to provide the sheet with an oxidic insulating layer of $FeO.SiO_2AL_2O_3$, and thus to avoid the necessity of coating the sheet with magnesia. Finally, another advantage associated with the aluminium content is that the sheet is resistant to age hardening, due to the binding of the nitrogen.

Figure 3:
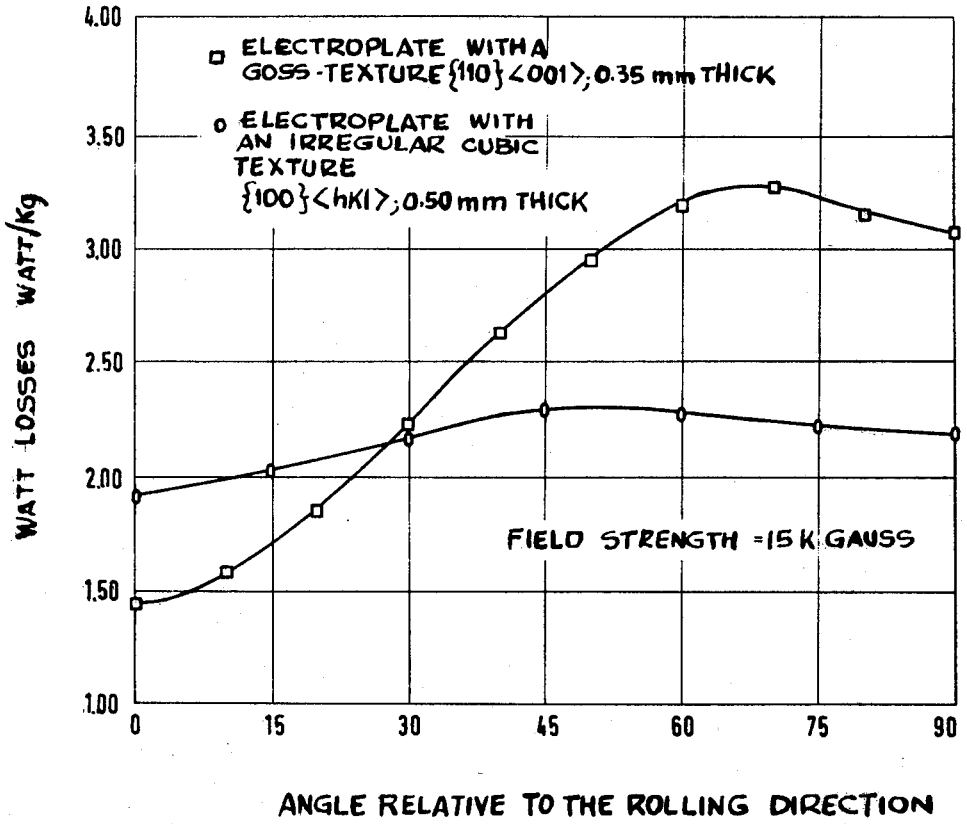

A comparison of the two curves of FIG. 3 clearly shows that the watt-losses are practically independent of the angle relative to the rolling direction, that is to say the steel possesses isotropic magnetic properties.

We claim:

1. A method of making cold-rolled sheet for electrical purposes, said sheet having isotropic magnetic properties, said method comprising the steps of hot rolling at a temperature of from 820° to 1080°C a steel consisting essentially of up to 0.1% carbon, from 0.15% to 0.35% manganese, from 0.3% to 2.4% aluminium, up to 0.25% copper, up to 0.05% sulphur, up to 0.2% phosphorus, up to 2.0% silicon and the balance iron except for impurities, to bring at least 5% of the grains into a {100} <hkl> - orientation, cold-rolling said sheet with a reduction in cross section of from 50% to 85% and subsequently recrystallisation-annealing said sheet at a temperature of from 820° to 1200°C. for a time sufficient to yield a product having a grain length at least five times the sheet thickness.

2. A method as claimed in claim 1, further comprising the step of reeling said sheet at a temperature of less than 720°C after said hot rolling.

3. A method as claimed in claim 1, further comprising the step of normalising said sheet after said hot rolling.

4. A method as claimed in claim 1, further comprising the step of decarburisation-normalising said sheet with said sheet possessing scale as a result of said hot rolling.

5. A method as claimed in claim 1, wherein said cold-rolling is carried out in two stages and further comprising the step of annealing said sheet for from 10 to 30 minutes at a temperature of from 550° to 950°C between said two stages.

6. A method as claimed in claim 1, wherein said cold-rolling is carried out in two stages, and further comprising the step of decarburisation-annealing said sheet between said two stages.

* * * * *